US011739740B2

(12) United States Patent
Stephenson et al.

(10) Patent No.: US 11,739,740 B2
(45) Date of Patent: Aug. 29, 2023

(54) ACTIVE ACCUMULATOR

(71) Applicant: Halliburton Energy Services, Inc., Houston, TX (US)

(72) Inventors: Stanley V. Stephenson, Duncan, OK (US); Joe A. Beisel, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 283 days.

(21) Appl. No.: 17/296,417

(22) PCT Filed: Dec. 31, 2018

(86) PCT No.: PCT/US2018/068173

§ 371 (c)(1),
(2) Date: May 24, 2021

(87) PCT Pub. No.: WO2020/142078

PCT Pub. Date: Jul. 9, 2020

(65) Prior Publication Data

US 2022/0025909 A1 Jan. 27, 2022

(51) Int. Cl.

| | |
|---|---|
| ***F04B 11/00*** | (2006.01) |
| ***F15B 1/033*** | (2006.01) |
| ***E21B 43/12*** | (2006.01) |
| ***F04B 49/06*** | (2006.01) |

(Continued)

(52) U.S. Cl.

CPC ..... *F04B 11/0008* (2013.01); *E21B 43/121* (2013.01); *E21B 43/126* (2013.01);

(Continued)

(58) Field of Classification Search

CPC .. F04B 9/10; F04B 47/04; F04B 51/00; F04B 47/02; F04B 49/065; F04B 11/0008;

(Continued)

(56) References Cited

U.S. PATENT DOCUMENTS

| | | | |
|---|---|---|---|
| 4,088,154 | A | 5/1978 | Patton |
| 8,899,940 | B2 | 12/2014 | Leguemors et al. |

(Continued)

FOREIGN PATENT DOCUMENTS

| | | | |
|---|---|---|---|
| JP | H03-164371 | A | 7/1991 |
| JP | H04-019369 | A | 1/1992 |

(Continued)

OTHER PUBLICATIONS

International Search Report and Written Opinion issued in related PCT Application No. PCT/US2018/068173 dated Sep. 26, 2019, 11 pages.

(Continued)

*Primary Examiner* — Peter J Bertheaud

(74) *Attorney, Agent, or Firm* — Conley Rose, P.C.; Rodney B. Carroll

(57) ABSTRACT

An active accumulator system which automatically adjusts or adapts the charge pressure or volume of an accumulator to maintain an optimal charge pressure or volume of the accumulator may provide optimal operation of a pump. An active accumulator system may comprise a flow line coupled to a pump, wherein a fluid flows through the flow line to the pump, an accumulator coupled to the flow line, a transducer coupled to the pump, wherein the transducer detects a parameter of the pump at an inlet of the pump, and a controller coupled to the transducer and the accumulator, wherein the controller receives the parameter, and wherein the controller regulates air flow to the accumulator such that the accumulator is adjusted to an optimal charge pressure based at least in part on the parameter.

22 Claims, 4 Drawing Sheets

(51) Int. Cl.

| | |
|---|---|
| ***F04B 47/04*** | (2006.01) |
| ***F04B 9/10*** | (2006.01) |
| ***F04B 51/00*** | (2006.01) |
| ***F04B 47/02*** | (2006.01) |
| ***F04B 47/00*** | (2006.01) |

(52) U.S. Cl.
CPC ..... *E21B 43/129* (2013.01); *F04B 9/10* (2013.01); *F04B 47/02* (2013.01); *F04B 47/04* (2013.01); *F04B 49/065* (2013.01); *F04B 51/00* (2013.01); *F15B 1/033* (2013.01); *F04B 47/00* (2013.01); *F04B 2205/01* (2013.01); *F15B 2201/50* (2013.01); *F15B 2201/51* (2013.01); *F15B 2211/8609* (2013.01)

(58) Field of Classification Search
CPC .... F04B 47/00; F04B 2205/01; E21B 43/129; E21B 43/121; E21B 43/126; F15B 1/033; F15B 2201/50; F15B 2201/51; F15B 2211/8609
See application file for complete search history.

(56) References Cited

U.S. PATENT DOCUMENTS

| | | | | |
|---|---|---|---|---|
| 9,121,397 | B2 | 9/2015 | Marica | |
| 9,291,157 | B1 | 3/2016 | Darsey | |
| 2018/0299157 | A1* | 10/2018 | Jang | F24F 11/89 |

FOREIGN PATENT DOCUMENTS

| | | | |
|---|---|---|---|
| JP | 2002-130597 | A | 5/2002 |
| JP | 2010-133471 | A | 6/2010 |
| WO | 2014/091953 | A1 | 6/2014 |

OTHER PUBLICATIONS

International Preliminary Report on Patentability issued in related PCT Application No. PCT/US2019/068173, dated Jul. 15, 2021, 8 pages.

* cited by examiner

ACTIVE ACCUMULATOR

CROSS-REFERENCE TO RELATED APPLICATION

The present application is a U.S. National Stage Application of International Application No. PCT/US2018/068173 filed Dec. 31, 2018, which is incorporated herein by reference in its entirety for all purposes.

TECHNICAL FIELD

The present disclosure relates generally to systems and methods for servicing a wellbore, and more particularly, to an active accumulator system and method for improving pumping operations.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps, for example, drilling a wellbore at a desired well site, treating the wellbore to optimize production of hydrocarbons, and performing the necessary steps to produce and process the hydrocarbons from the subterranean formation.

Standard accumulators, for example, passive or fixed accumulators, have been used with displacement pumps in all phases of well servicing operations including to pump water, cement, fracturing fluids, and other stimulation or servicing fluids as well as other pumping operations. In these systems, passive or fixed accumulators can only be optimally adjusted if the flowrates and line lengths of suction hoses or lines of each pumping unit remain constant. However, there are typically variations associated with each job during rig-up in flowrates and line lengths of suction hoses and other suction manifold lines from a blender to each pumping unit, causing the dynamic responses in suction lines to be different for each job. For example, prior to a job, a fixed or passive accumulator may be adjusted based on the expected flowrate and boost pressure. As the flowrate and pressure changes during a job, at certain flowrates, a resonance may occur inside the suction header on the pump, limiting the rate capability of the pump. The flowrate associated with resonance may vary for each job due to differences in rig-up and charge pressure. Thus, while fixed or passive accumulators may be effective at optimal charge pressures or volumes, maintaining optimal charge pressures or volumes with these accumulators may be difficult, causing performance to degrade as pump characteristics change.

Due to these changing suction characteristics of the pumps, the pumps may be subjected to a cavitating condition, which can have negative impacts on the job and shorten equipment life. Additionally, pressure drop in a suction hose, for example, a 50-70% pressure drop, between the blender and any pump may be due to acceleration and deceleration of fluid in the suction hose between the manifold trailer and the pump.

An active accumulator that automatically adjusts or adapts the charge pressure or volume of the accumulator to maintain optimal charge pressure or volume may provide optimal operation of the pump. Additionally, an active accumulator as disclosed herein can reduce the likelihood of the pumps operating in a cavitating condition and allow pumps that have poor suction characteristics to run at higher flowrates without cavitating. Automatically adjusting the charge pressure or volume may also minimize the fluid acceleration and deceleration in the suction hose.

BRIEF DESCRIPTION OF DRAWINGS

Some specific exemplary embodiments of the disclosure may be understood by referring, in part, to the following description and the accompanying drawings.

Figure 1:
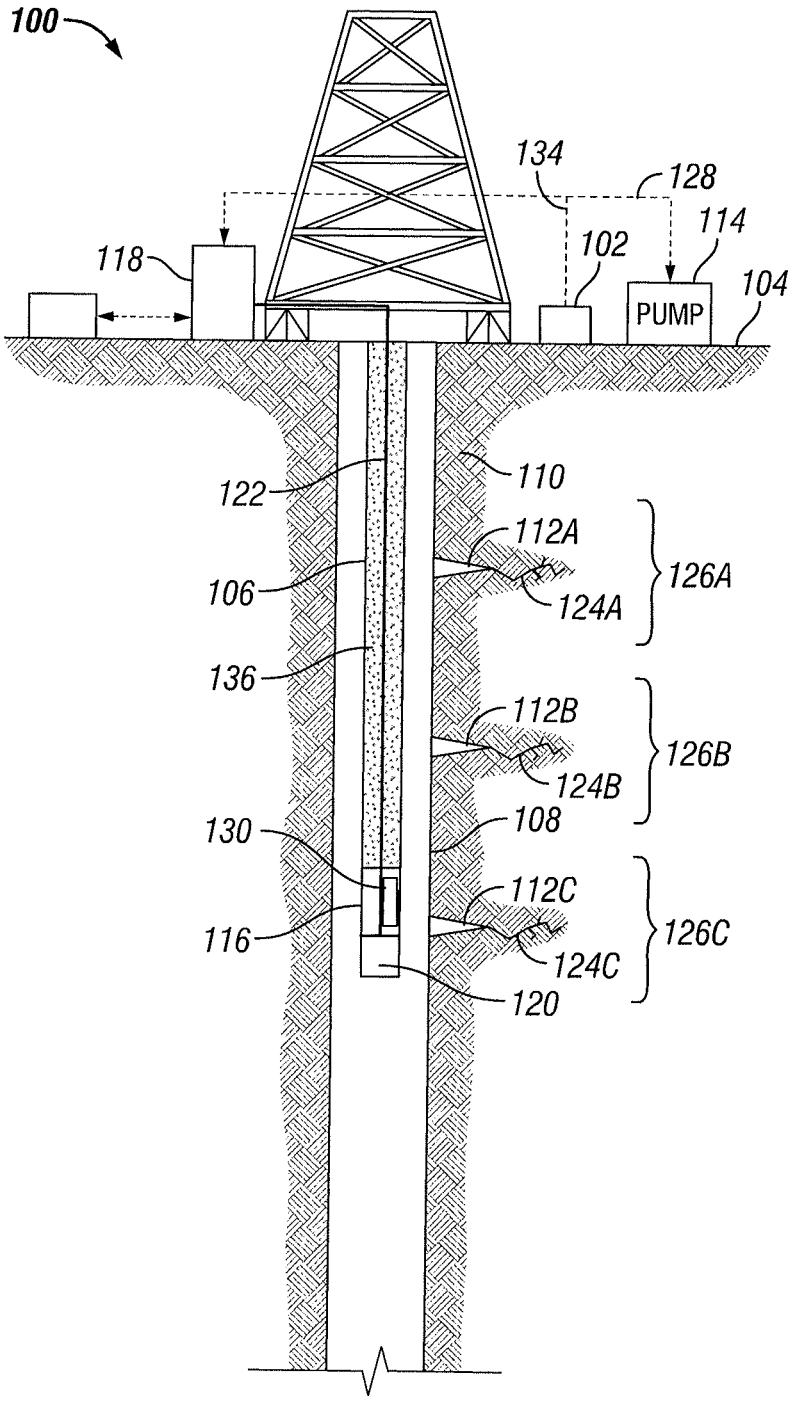
FIG. 1 is a cross-sectional schematic diagram depicting an example of a wellbore environment, according to one aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to servicing a wellbore and more particularly to improving and enabling pumping operations using an active accumulator. The active accumulator can adapt or adjust the charge pressure or volume of the accumulator to maximize the boost to an individual pump. While pumping, the pressure or other parameter at the suction header of the pump or a cavitation detector parameter may be used as feedback to a controller or control system. As cavitation is approached, the peak-to-peak pressure in the suction header is increased. The control system may adjust a regulator such that air or other suitable gas is added or withdrawn from the charge pressure of the accumulator until the peak-to-peak pressure in the suction header is at a minimum. Along with or independent of the suction pressure, a cavitation detector monitors cavitation in the pump. The control system adjusts the charge pressure or volume to minimize or eliminate cavitation. Changes in job flowrate or individual pump flowrates may alter the charge pressure or volume needed in the accumulator to maximize the boost pressure reaching the pump. By monitoring and adjusting the charge pressure in real-time, the active accumulator maintains the optimal charge pressure or internal volume for any given rig-up condition or changes in flowrate or suction pressure.

In one or more aspects of the present disclosure, a well site operation may utilize an information handling system to control one or more operations including, but not limited to, an accumulator, for example, an active accumulator, a motor or powertrain, a downstream pressurized fluid system, or any other equipment. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple" or "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

Various aspects of the present disclosure may be implemented in various environments. While FIG. 1 illustrates an onshore environment, the present disclosure contemplates an offshore or subsea environment. While FIG. 1 illustrates a substantially vertical wellbore 108, the present disclosure contemplates that any wellbore shape including but not limited to vertical, horizontal, curved or any angle of deviation. The wellbore environment 100 includes a casing string 106 that extends below the surface 104 and into a wellbore 108. The wellbore 108 may extend through subterranean formation 110 in the earth adjacent to the wellbore 108.

The wellbore 108 may be divided into one or more stages for stimulation treatment, for example, stages 126A, 126B and 126C, collectively referred to as stages 126. Each stage 126 may be any length and may be separated from any one or more other stages 126 by any distance. The subterranean formation 110 may include one or more perforations or openings associated with the one or more stages 126, for example, perforation 112A associated with stage 126A, perforation 112B associated with stage 126B and perforation 112C associated with stage 126 C. While only a single perforation 112 is illustrated associated with each stage 126, the present disclosure contemplates any one or more perforations 112 associated with any one or more stages 126. The present disclosure also contemplates that the number or quantity of perforations 112 associated with each stage 126 may differ or vary and that the interval and spacing of one or more perforations 112 within any stage 126 may vary. The perforations 112A, 112B and 112C are referred to generally herein as perforations 112. Each perforation 112, may be extended or fractured deeper into the formation 110, for example, perforation 112A may be extended as shown by fracture 124A, perforation 112B may be extended as shown by fracture 124B and perforation 112C may be extended as shown by fracture 124C. Fractures 124A, 124B and 124C are collectively referred to herein as fracture 124. In one or more embodiments, the perforation 112 or the fracture 124 may be a separation of the subterranean formations 110 forming a fissure or crevice in the subterranean formations 110. Any one or more fractures 112 may serve as a path for the production of hydrocarbons from subterranean reservoirs.

A wireline or coiled tubing 122 may be disposed or positioned within the wellbore 108. Any one or more of perforating tool 116, a termination point or isolator 120 and any other downhole tool may be positioned or disposed downhole via the wireline or coiled tubing 122. For example, wireline or coiled tubing 122 may couple to a perforating tool 116 to provide power, communications or both to the perforating tool 116. In one or more embodiments a termination point or isolator 120 may comprise a plug, a barrier, a bottom of the wellbore 108, or any other termination point or isolator that sections off one or more portions of a wellbore 108. In one or more embodiments, a termination point or isolator 120 may be coupled to the perforating tool 116 or may be set at a location in the wellbore 108 prior to positioning the perforating tool 116 within the wellbore 108. In one or more embodiments, the perforating tool 116 comprises one or more explosive charges 130. Upon receiving a command or actuation, the perforating tool 116 detonates one or more explosive charges 130 to create one or more perforations 112. In one or more embodiments, the wireline or coiled tubing 122 retracts to retrieve the perforation tool 116, the termination point or isolator 120 or both. In one or more embodiments, the perforation tool 116, the termination point or isolator 120 or both may be disengaged from the wireline or coiled tubing 122 and released into the wellbore 108 prior to retracting the wireline or coiled tubing 122.

A pump 114 is positioned or disposed at a surface 104 proximate to the wellbore 108. Pump 114 couples to conduit 128 via conduit 134. Conduit 128 fluidically couples to the wellbore 108. The pump 114 pumps one or more fluids via conduit 128 into the wellbore 108. An injection pumping system 102 may couple to conduit 128 to inject pressure pulses or waves via the one or more fluids pumped by pump 114 through conduit 128 to extend or fracture one or more perforations 112, for example, to form one or more fractures 124.

Figure 2:
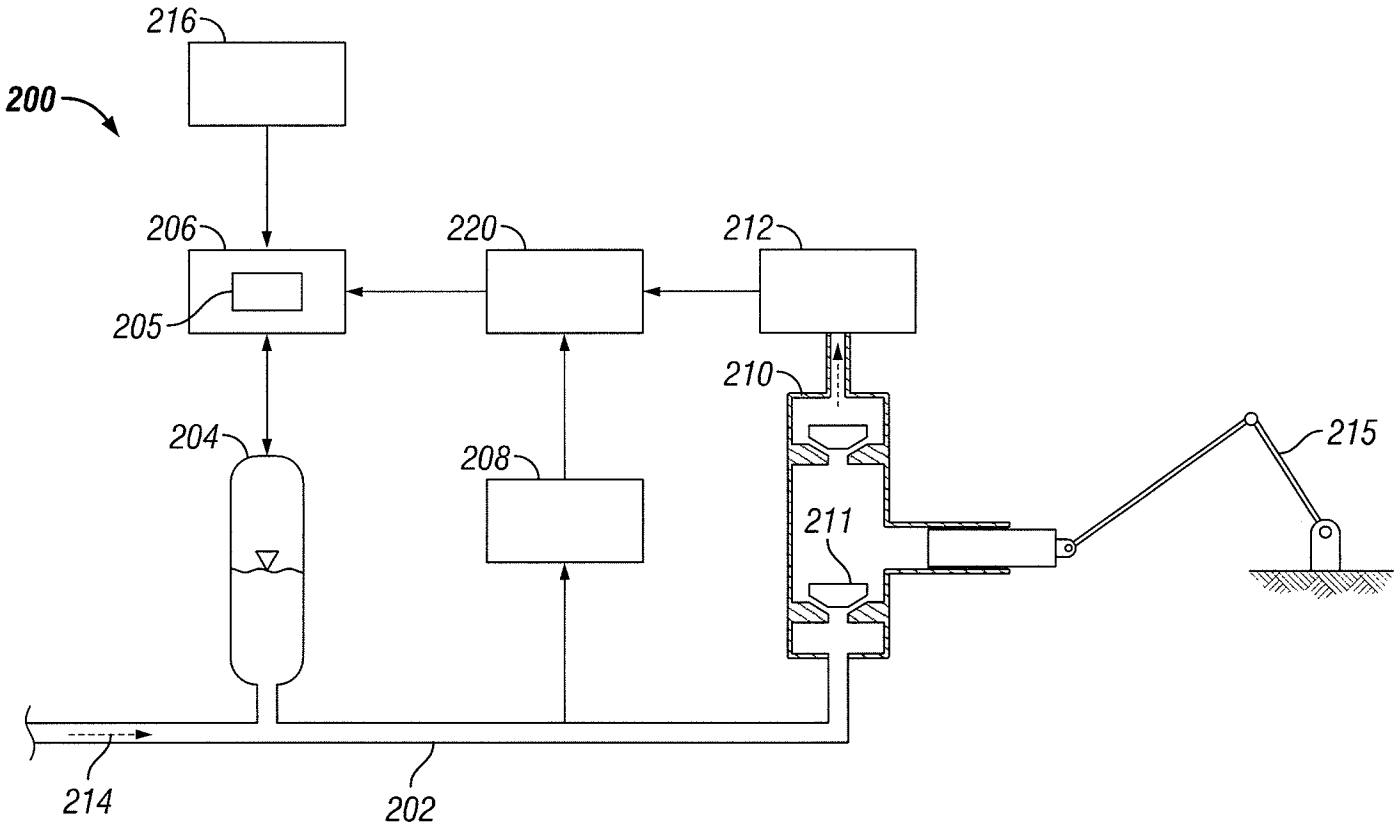
FIG. 2 is a diagram illustrating an active accumulator pumping system, according to one or more aspects of the present disclosure.

A control unit 118 may couple to any one or more devices, components or equipment at the environment 100, for example, accumulator system 200 as discussed with respect to FIG. 2. Control unit 118 may monitor or control any one or more devices, components or equipment at the environment 100. For example, control unit 118 may communicate a command via the wireline or coiled tubing 122 to the perforating tool 116 to cause the perforating tool 116 to detonate one or more explosive charges 130. In one or more embodiments, control unit 118 controls injection pump 102. For example, control unit 118 may transmit a command to injection pump 102 that causes injection pump 102 to generate one or more pressure pulses or waves at one or more timed intervals or in a specified sequence. In one or more embodiments, control unit 118 may comprise one or more information handling systems, for example, information handling system 300 of FIG. 3.

FIG. 2 is a diagram illustrating an active accumulator system 200, according to one or more aspects of the present disclosure. In one or more embodiments, active accumulator system 200 may comprise a flow line 202, accumulator 204, pressure regulator 206, pump 210, controller 220, and air source 216. Flow line 202 may transfer fluid 214 from a blender or low-pressure manifold (not shown) to a pump 210 to be pumped downhole, for example, pumped to a wellbore 108. In one or more embodiments, flow line 202 may comprise a suction hose, suction line, discharge line, or any other manifold line as would be understood by one of ordinary skill in the art.

An accumulator 204 may be positioned or disposed along or coupled to a flow line 202 to provide a fluid pressure boost to the pump 210, which may be located at an end or outlet of line 202. In one or more embodiments, accumulator 204 may be a standard fixed or passive accumulator as discussed herein. In one or more embodiments, accumulator 204 may be any accumulator that allows for regulation of the charge pressure or volume of the accumulator. For example, accumulator 204 may be coupled to a pressure regulator 206. The pressure regulator 206 may add or withdraw air or other suitable gas to adjust the charge pressure of the accumulator 204. Thus, pressure regulator 206 may regulate the pressure contained within the accumulator 204 by adding air when needed to increase the charge pressure inside accumulator 204 or letting out air to decrease the charge pressure inside accumulator 204. In one or more embodiments, the internal volume of accumulator 204 may be adjusted. For example, accumulator 204 may comprise a movable piston (not shown) coupled to an inner wall of accumulator 204 for adjusting the internal volume of accumulator 204. In one or more embodiments, a piston, bladder, or other device may be used to isolate the gas charge side (adjustable side) from the fluid side to prevent contamination of the adjustable side with the fluid side. In one or more embodiments, other characteristics of accumulator 204 may be adjusted, for example, the temperature inside accumulator 204.

Pressure regulator 206 may comprise or be coupled to an air source 216. Air source 216 may provide oxygen, nitrogen, other inert gas, or any other suitable gas for increasing the charge pressure of the accumulator 204. In one or more embodiments, air source 216 may store liquified gas to provide more volume of charge gas available in a small container. In one or more embodiments, air source 216 may further comprise an air compressor for pressurizing the air stored in air source 216. Air source 216 may be coupled to a supply side of pressure regulator 206 such that pressure regulator 206 may only allow enough gas to pass through to achieve a desired pressure downstream. In one or more embodiments, pressure regulator 206 may comprise a valve 205 for allowing or restricting gas flow from air source 216 to accumulator 204. For example, a valve 205 of pressure regulator 206 may comprise an open and a closed position, where the valve 205 allows air to flow to the accumulator 204 when the valve 205 is in an open position, and where the valve 205 restricts air flow to the accumulator 204 when the valve 205 is in a closed position. In one or more embodiments, the pressure regulator 206 may be configured on accumulator 204 such that pressure regulator 206 may release air from the accumulator 204 to decrease the charge pressure of accumulator 204. For example, in one or more embodiments, pressure regulator 206 may comprise a dump valve for lowering the pressure of accumulator 204.

In one or more embodiments, pressure regulator 206 need not be a separate component. For example, accumulator 204 may comprise a pressure regulator 206. In one or more embodiments, pressure regulator 206 may not be required in the active accumulator system 200. For example, accumulator 204 may be coupled directly to air source 216. In these embodiments, gas from air source 216 may be fed to accumulator 204 to increase the charge pressure, and accumulator 204 may comprise a valve (not shown) for releasing air to decrease the charge pressure. As would be understood by one of ordinary skill in the art, the charge pressure of accumulator 204 may be maintained at an optimal charge pressure using a variety of components for allowing, restricting, withdrawing, or any combination thereof, of gas from the accumulator 204.

A transducer 208 may be coupled to or mounted on the pump 210, for example at the suction header or inlet 211 of the pump 210, for monitoring the fluid pressure or other relevant metric at the pump 210. As shown in FIG. 2, in one or more embodiments, pump 210 may comprise a single plunger 215 of a multi-plunger fracture pump (not shown). In one or more embodiments, transducer 208 may be a pressure transducer that is operable to monitor the fluid pressure entering the pump 210 at the suction header 211. In one or more embodiments, transducer 208 may monitor one or more characteristics such as fluid temperature, percent fill of each pump chamber, or volumetric efficiency of the pump. As would be understood by one of ordinary skill in the art, additional instrumentation may be required to measure these parameters. Controller 220 may be communicatively coupled, either directly or indirectly, wired or wirelessly or any combination thereof, to transducer 208. In one or more embodiments, controller 220 may comprise a transducer 208.

In one or more embodiments, controller 220 may be pre-programmed with a threshold pressure which may be indicative of a pump condition, for example, a cavitation condition. For example, it may be desirable to keep the pressure at the pump inlet 211 above the Net Positive Suction Head Required (NPSHR) for the pump. The NPSHR for the pump may be the pressure required for the pump to operate properly. In one or more embodiments, the threshold pressure may include a range of pressures. Controller 220 may be coupled, directly or indirectly, wired or wireless, or any combination thereof to pressure regulator 206. As pressure in line 202 reaches, exceeds, or both a threshold pressure, controller 220 may send or transmit a signal to pressure regulator 206, accumulator 204, or both. The signal may cause the pressure regulator 206 to add or withdraw the amount of gas provided to accumulator 204, thus effecting the charge pressure on accumulator 204. The relationship of the charge pressure to the amount of gas may be defined by $PV=nRT$, where P is the pressure, V is the volume, n is the amount of gas, T is the temperature of the gas, and R is the universal gas constant or Boltzmann constant. As described above, it may be desirable to alter or adjust the internal volume of the accumulator, in addition to or instead of the charge pressure. Adjusting the charge pressure, internal volume, or both of the accumulator may affect the frequency response of the active accumulator system 200.

In one or more embodiments, the threshold pressure may be previously stored, for example, in a file, memory, or a database, be input by an operator, or updated in real-time by the controller 220 based on predetermined operating characteristics of the pump 210. The controller 220 may adjust the pressure regulator 206, accumulator 204, or both such that the peak-to-peak pressure in the suction header 211 of pump 210 is a minimum. The peak-to-peak pressure of pump 210 may represent the variation in pressure under steady-state conditions. Thus, minimizing the peak-to-peak pressure of the pump 210 minimizes the variation of the pressure signal. The suction pressure of a pump 210 may indicate a poor operating condition of the pump 210.

In one or more embodiments, active accumulator system 200 may further comprise a cavitation detector 212 for monitoring cavitation in the pump 210. Cavitation detector 212 may monitor one or more pump performance characteristics or parameters such as percent fill of each pump chamber or volumetric efficiency while pumping. Cavitation detector 212 may determine the degree of cavitation of pump 210. For example, cavitation detector 212 may determine the degree of cavitation by comparing the volumetric flow rates into and out of a pump 210. In one or more embodiments, cavitation detector 212 may monitor any one or more other characteristics such as fluid pressure or fluid temperature. As would be understood by one of ordinary skill in the art, monitoring any one or more of the aforementioned characteristics may indicate a cavitation condition, for example, vaporization of fluid being pumped resulting in incomplete fill of the pump chamber before the pump goes on a discharge stroke. Cavitation detector 212 may be coupled, directly or indirectly, wired or wireless or any combination thereof, to controller 220. Cavitation detector 212 sends or transmits a feedback signal to controller 220. The controller 220 compares the feedback signal from the cavitation detector 212 to a cavitation threshold. When the cavitation threshold is reached, exceeded, or both, the controller 220 may send a signal to pressure regulator 206, accumulator 204, or both to adjust the charge pressure of accumulator 204 to minimize or eliminate cavitation.

Thus, active accumulator system 200 automatically adjusts to and maintains the optimal charge pressure of accumulator 204 based on a particular flowrate or rig-up condition. In one or more embodiments, the active accumulator system 200 automatically adjusts and maintains the volume of accumulator 204 based on a particular flowrate or rig-up condition. In one or more embodiments, the optimal charge pressure and optimal volume of an accumulator may be defined as the charge pressure and the volume, respectively, of the accumulator when the peak-to-peak suction header pressure is at a minimum. Typical flowrates of pumps may range from 1-20 bpm, however, the active accumulator system 200 may be operable under other flowrates. For example, active accumulator system 200 can adapt to changes in flowrate that may be required over the course of a particular job. Active accumulator system 200 may be configured to automatically adapt to changes in job flowrate or individual pump flowrate. The ability of active accumulator system 200 to adapt to such changes in flowrate maintains the optimal charge pressure to be supplied to accumulator 204 to maximize the boost pressure reaching the pump 210.

In one or more embodiments, the active accumulator system 200 may use a dithering technique to determine the optimal charge pressure or volume of accumulator 204. For example, the active accumulator system 200 may incrementally adjust a charge pressure or volume while monitoring a parameter. If the parameter indicates improved performance, the active accumulator system 200 may continue to adjust a charge pressure or volume until reaching an optimal charge pressure or volume. If the parameter begins to indicate decreased performance, the active accumulator system 200 may reverse or reduce the adjustment in charge pressure or volume.

Figure 3:
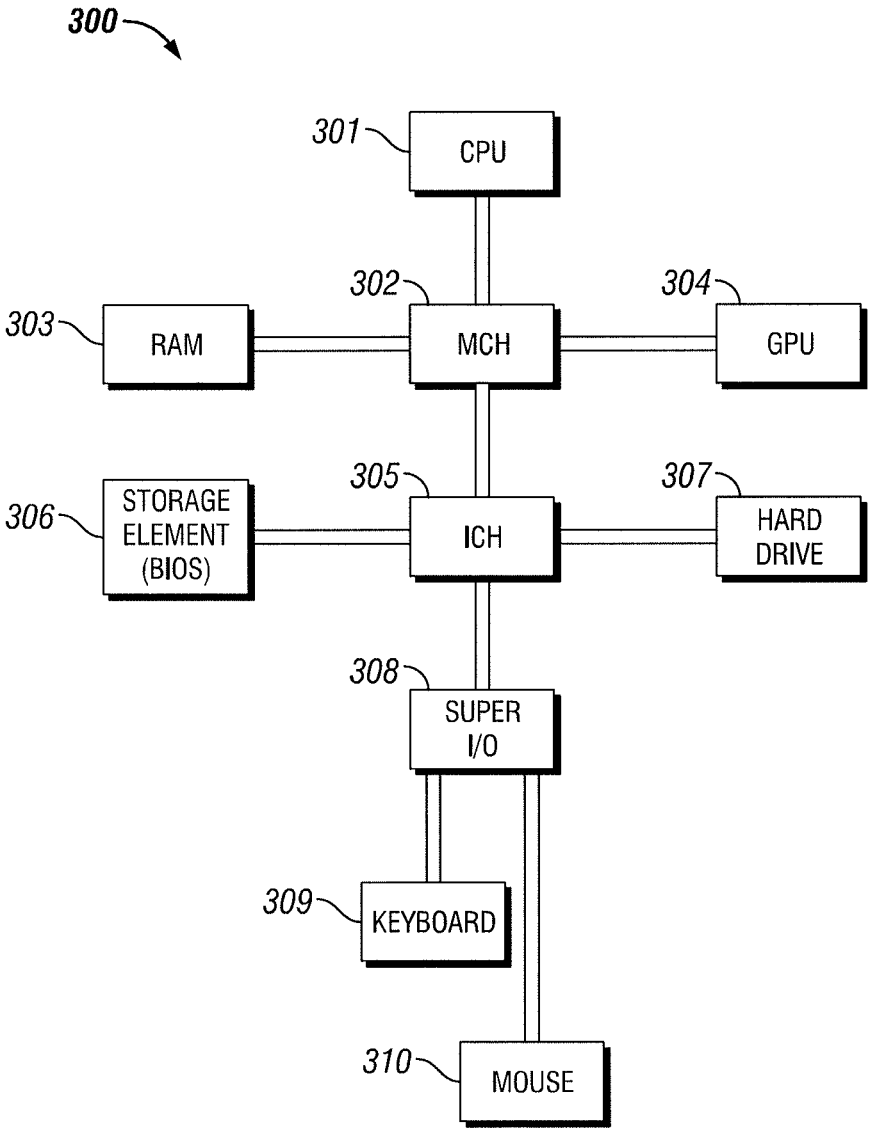
FIG. 3 is a diagram illustrating an example information handling system, according to one or more aspects of the present disclosure.

FIG. 3 is a diagram illustrating an example information handling system 300, according to aspects of the present disclosure. Any one or more of control unit 118 and the controller 220 may take a form similar to the information handling system 300. A processor or central processing unit (CPU) 301 of the information handling system 300 is communicatively coupled to a memory controller hub or north bridge 302. The processor 301 may include, for example a microprocessor, microcontroller, digital signal processor (DSP), application specific integrated circuit (ASIC), or any other digital or analog circuitry configured to interpret and/or execute program instructions and/or process data. Processor 301 may be configured to interpret and/or execute program instructions or other data retrieved and stored in any memory such as memory 303 or hard drive 307. Program instructions or other data may constitute portions of a software or application for carrying out one or more methods described herein. Memory 303 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or an application may be retrieved and stored in memory 303 for execution by processor 301.

Modifications, additions, or omissions may be made to FIG. 3 without departing from the scope of the present disclosure. For example, FIG. 3 shows a particular configuration of components of information handling system 300. However, any suitable configurations of components may be used. For example, components of information handling system 300 may be implemented either as physical or logical components. Furthermore, in some embodiments, functionality associated with components of information handling system 300 may be implemented in special purpose circuits or components. In other embodiments, functionality associated with components of information handling system 300 may be implemented in configurable general purpose circuit or components. For example, components of information handling system 300 may be implemented by configured computer program instructions.

Memory controller hub (MCH) 302 may include a memory controller for directing information to or from various system memory components within the information handling system 300, such as memory 303, storage element 306, and hard drive 307. The memory controller hub 302 may be coupled to memory 303 and a graphics processing unit 304. Memory controller hub 302 may also be coupled to an I/O controller hub (ICH) or south bridge 305. I/O hub 305 is coupled to storage elements of the information handling system 300, including a storage element 306, which may comprise a flash ROM that includes a basic input/output system (BIOS) of the computer system. I/O hub 305 is also coupled to the hard drive 307 of the information handling system 300. I/O hub 305 may also be coupled to a super I/O chip 308, which is itself coupled to several of the I/O ports of the computer system, including keyboard 309 and mouse 310.

Figure 4:
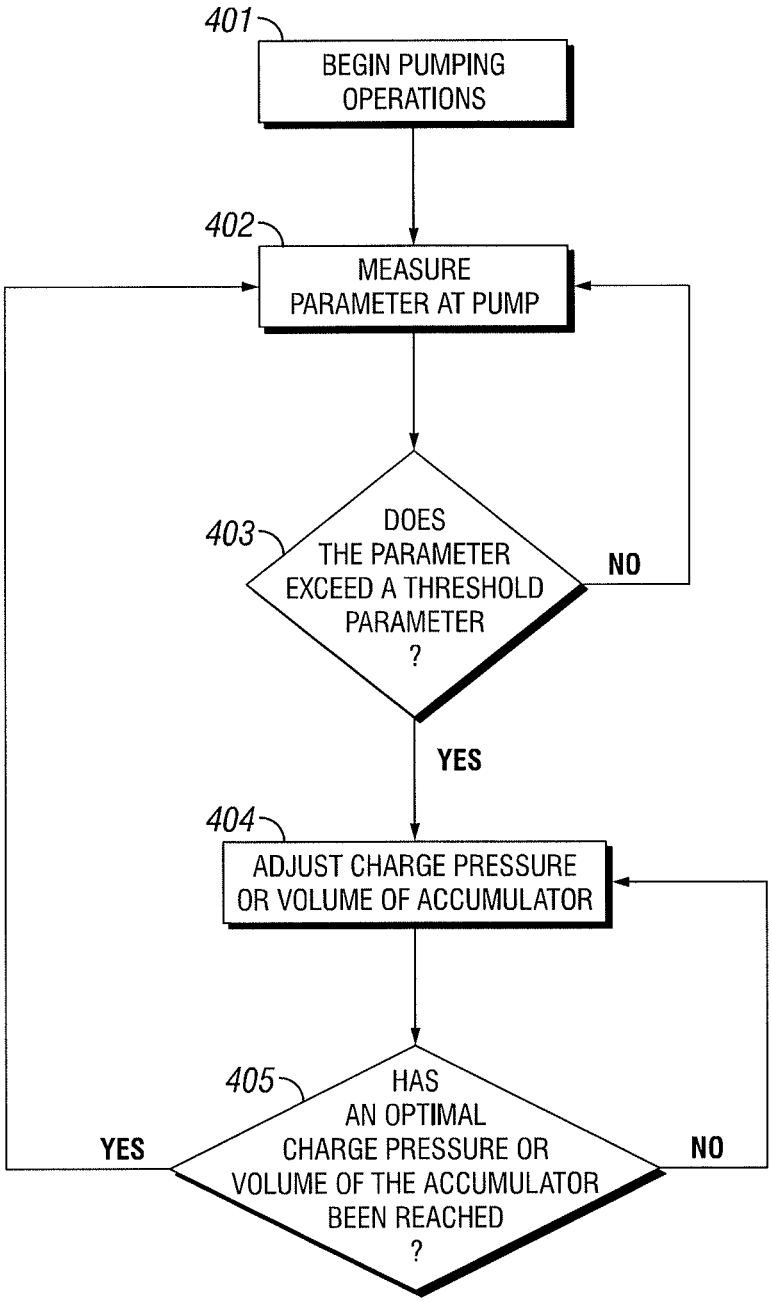
FIG. 4 is flowchart for operation of an active accumulator system, according to one or more aspects of the present disclosure.

FIG. 4 is a flowchart illustrating an active accumulator system 200, according to one or more aspects of the present disclosure. The present disclosure provides an efficient method of maintaining the optimal charge pressure or volume of an accumulator despite varying flowrates and line lengths of suction hoses.

In one or more embodiments, at step 401, pumping operations are commenced wherein fluid is delivered via line 202 to pump 210, as illustrated in FIG. 2. At step 402, a parameter, for example, fluid pressure, is measured at the suction head or inlet 411 of the pump 210 using transducer 208. As previously discussed, in one or more embodiments, transducer 208 may be configured to monitor or detect another metric in addition to or instead of fluid pressure. In one or more embodiments, measurements may be taken continuously and provided to the controller 220 in real-time. In one or more embodiments, controller 220 may instruct transducer 208 to detect and record a measurement at a specific time.

At step 403, controller 220 compares the measured parameter to a threshold parameter. In one or more embodiments, the threshold parameter may be provided to or initially set by a controller 220 before pumping operations begin in step 401. In one or more embodiments, the threshold parameter may be determined by controller 220 based on one or more characteristics of pump 210. For example, the threshold parameter may be a threshold pressure determined based on the NPSHR of a particular pump or an initial fluid pressure or flowrate in flow line 202 once pumping has begun. In one or more embodiments, a threshold parameter may be determined by a monitored parameter by transducer 208, cavitation detector 212, or both. The threshold parameter may be determined based on any one or more characteristics of the particular pump 210, one or more pumps 210, or a particular job.

If controller 220 determines that the pressure measured by transducer 208 exceeds, meets, or both a threshold parameter, the process proceeds to step 404. If the parameter measured by transducer 208 does not exceed a threshold parameter, or in one or more embodiments, does not fall into a threshold range of parameters, the process may return to step 402 and another measurement may be taken by transducer 208. In one or more embodiments, measurements may be taken continuously by transducer 208 and sent to controller 220 for comparison.

At step 404, controller 220 may send a signal to pressure regulator 206, accumulator 204, or both to allow or restrict the amount of gas flow from air source 216 to accumulator 204. For example, controller 220 may send a signal to regulator 206 to close a valve 205 to limit the gas flow to accumulator 204, and thus, reducing the charge pressure of accumulator 204. In one or more embodiments, controller 220 may send a signal to regulator 206 to open a valve 205 to increase the gas flow to accumulator 204 and thus, increase the charge pressure of accumulator 204. In one or more embodiments, controller 220 may send a signal directly to accumulator 204 to increase or decrease the gas flow from air source 216 to accumulator 204. In one or more embodiments, the controller 220 may send a signal to accumulator 204 to adjust the volume of accumulator 204.

At step 405, controller 220 may determine whether or not the accumulator has an optimal charge pressure or volume. As described above, determining an optimal charge pressure or volume may be made by determining a minimum peak-to-peak suction header pressure. In one or more embodiments, the optimal charge pressure or volume may be made based on the charge pressure or volume that maximizes the boost pressure of the fluid reaching pump 210. If controller 220 determines that the adjustment in step 405 results in an optimal charge pressure or volume of accumulator 204, the process may return to step 402. However, if controller 220 determines that that adjustment in step 404 does not result in an optimal charge pressure or volume of accumulator 204, the process may return to step 404 for further adjustments to the charge pressure, volume, or both of accumulator 204.

In one or more embodiments, adjusting the accumulator 204 to an optimal charge pressure or volume may comprise monitoring an incremental adjustment to the charge pressure or volume to determine if the adjustment is appropriate. For example, controller 220 may not know whether to increase or decrease the charge pressure or volume in response to detecting a threshold parameter. Thus, controller 220 may make an initial incremental adjustment at step 404 and determine whether improvements in the parameter are realized or not. Controller 220 may detect measurements taken by regulator 206, cavitation detector 212, or both to determine whether or not an incremental adjustment has resulted in an improvement in the monitored parameter. If improvements are realized, the controller 220 may return to step 404 and continue to make additional adjustments until an optimal pressure or volume is reached.

Thus, the present disclosure provides and improved system and method for optimizing the charge pressure of an accumulator by adapting the charge pressure to operate at varying flowrates without cavitation. Operating without cavitation improves asset utilization and reduces maintenance costs associated with various pieces of equipment, including lengthening the life of fluid ends, power ends, transmissions, and drive shafts which are ordinarily impacted by cavitation.

In one or more embodiments, an active accumulator system comprises a flow line coupled to a pump, wherein a fluid flows through the flow line to the pump, an accumulator coupled to the flow line, a transducer coupled to the pump, wherein the transducer detects a parameter of the pump at an inlet of the pump, and a controller coupled to the transducer and the accumulator, wherein the controller receives the parameter, and wherein the controller regulates air flow to the accumulator to adjust the accumulator to an optimal charge pressure based at least in part on the parameter. In one or more embodiments, the parameter is indicative of a suction header pressure of the fluid. In one or more embodiments, the controller adjusts the accumulator to an optimal volume. In one or more embodiments, the active accumulator system further comprises a cavitation detector coupled to the pump, wherein the cavitation detector monitors a cavitation condition of the pump. In one or more embodiments, the cavitation detector monitors volumetric flowrates into and out of the pump. In one or more embodiments, the cavitation detector is coupled to the controller, and the cavitation detector provides a feedback signal to the controller. In one or more embodiments, the controller receives the cavitation condition, and the controller regulates air flow to the accumulator based on the cavitation condition. In one or more embodiments, the transducer is a pressure transducer. In one or more embodiments, the active accumulator further comprises an air source coupled to the accumulator and a regulator coupled to the air source, wherein the regulator at least one of allows air flow to the accumulator and restricts air flow to the accumulator. In one or more embodiments, the accumulator comprises the regulator.

In one or more embodiments, a method comprises the steps of detecting a parameter at a pump via a transducer coupled to the pump, wherein a fluid flows through a flow line to the pump, comparing the parameter to a threshold parameter via a controller, wherein the controller is communicatively coupled to an accumulator, and adjusting the accumulator to at least one of an optimal charge pressure and an optimal volume based on the comparison, wherein the accumulator is coupled to the flow line. In one or more embodiments, the parameter is a suction header fluid pressure of the fluid. In one or more embodiments, the at least one of the charge pressure and the volume of the accumulator is adjusted to a minimum suction header pressure of the pump. In one or more embodiments, the threshold parameter is a volumetric flow rate indicative of a cavitation condition of the pump. In one or more embodiments, the adjusting the at least one of the charge pressure and the volume of the accumulator comprises at least one of adding gas to the accumulator and withdrawing gas from the accumulator. In one or more embodiments, the at least one of adding gas to the accumulator and withdrawing gas from the accumulator is performed automatically by a regulator.

In one or more embodiments, a non-transitory storage computer readable medium storing one or more instructions that when executed by the processor, cause the processor to detect a parameter at a pump via a transducer coupled to the pump, wherein a fluid flows through a flow line to the pump, compare the parameter to a threshold parameter via a controller, wherein the controller is communicatively coupled to an accumulator; and adjust at least one of a charge pressure and a volume of the accumulator based on the comparison, wherein the accumulator is coupled to the flow line. In one or more embodiments, the parameter is a suction header fluid pressure. In one or more embodiments, the one or more instructions, that when executed by the processor, further cause the processor to at least one of add gas to the accumulator or withdraw gas from the accumulator to adjust the accumulator to an optimal charge pressure. In one or more embodiments, the one or more instructions, that when executed by the processor, further cause the processor to detect a cavitation condition and send a signal to the accumulator in response to detecting the cavitation condition.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. An active accumulator system, comprising:

a flow line coupled to a pump, wherein a fluid flows through the flow line to the pump;

an accumulator coupled to the flow line;

a transducer coupled to the pump, wherein the transducer detects a parameter of the pump at an inlet of the pump;

a cavitation detector coupled to the pump, wherein the cavitation detector monitors a cavitation condition of the pump; and a controller coupled to the transducer, the cavitation detector, and the accumulator, wherein the controller receives the parameter, and wherein the controller regulates air flow to the accumulator to adjust the accumulator to an optimal charge pressure based at least in part on the parameter.

2. The active accumulator system of claim 1, wherein the parameter is indicative of a suction header pressure of the fluid.

3. The active accumulator system of claim 1, wherein the controller adjusts the accumulator to an optimal volume.

4. The active accumulator system of claim 1, wherein the cavitation detector monitors volumetric flowrates into and out of the pump.

5. The active accumulator system of claim 1, wherein the cavitation detector provides a feedback signal to the controller.

6. The active accumulator system of claim 1, wherein the controller receives the cavitation condition, and wherein the controller regulates air flow to the accumulator based on the cavitation condition.

7. The active accumulator system of claim 1, wherein the transducer is a pressure transducer.

8. The active accumulator system of claim 1, further comprising:

an air source coupled to the accumulator; and a regulator coupled to the air source, wherein the regulator at least one of allows air flow to the accumulator and restricts air flow to the accumulator.

9. The active accumulator system of claim 8, wherein the accumulator comprises the regulator.

10. A method, comprising the steps of:

detecting a parameter at a pump via a transducer coupled to the pump, wherein a fluid flows through a flow line to the pump, and wherein the threshold parameter is a volumetric flow rate indicative of a cavitation condition of the pump;

comparing the parameter to a threshold parameter via a controller, wherein the controller is communicatively coupled to an accumulator; and adjusting the accumulator to at least one of an optimal charge pressure and or an optimal volume based on the comparison, wherein the accumulator is coupled to the flow line.

11. The method of claim 10, wherein the parameter is a suction header fluid pressure of the fluid.

12. The method of claim 10, wherein the at least one of the optimal charge pressure or the optimal volume of the accumulator is adjusted to a minimum suction header pressure of the pump.

13. The method of claim 11, wherein the adjusting the accumulator to at least one of the optimal charge pressure or the optimal volume comprises at least one of adding gas to the accumulator or withdrawing gas from the accumulator.

14. The method of claim 13, wherein the at least one of adding gas to the accumulator or withdrawing gas from the accumulator is performed automatically by a regulator.

15. A controller configured to automatically adjust an accumulator, comprising:

one or more processors;

at least one non-transitory memory; and one or more instructions stored in the at least one non-transitory memory that, when executed by the one or more processors, configure the controller to perform a method comprising:

detecting a parameter at a pump via a transducer coupled to the pump, wherein a fluid flows through a flow line to the pump;

comparing the parameter to a threshold parameter via the controller, wherein the controller is communicatively coupled to the accumulator;

detecting a cavitation condition and sending a signal to the accumulator in response to detecting the cavitation condition; and adjusting at least one of a charge pressure or a volume of the accumulator based on the comparison, wherein the accumulator is coupled to the flow line.

16. The controller of claim 15, wherein the parameter is a suction header fluid pressure.

17. The controller of claim 15, wherein the one or more instructions, that when executed by the controller, further cause the controller to perform the method further comprising at least one of adding gas to the accumulator or withdrawing gas from the accumulator to adjust the accumulator to an optimal charge pressure.

18. The method of claim 10, wherein a cavitation detector is coupled to the pump, wherein the cavitation detector monitors a cavitation condition of the pump, and wherein the cavitation detector monitors volumetric flowrates into and out of the pump.

19. An active accumulator system, comprising:

a flow line coupled to a pump, wherein a fluid flows through the flow line to the pump;

an accumulator coupled to the flow line;

an air source coupled to the accumulator;

a regulator coupled to the air source, wherein the regulator at least one of allows air flow to the accumulator or restricts air flow to the accumulator;

a transducer coupled to the pump, wherein the transducer detects a parameter of the pump at an inlet of the pump; and a controller coupled to the transducer and the accumulator, wherein the controller receives the parameter, and wherein the controller regulates air flow to the accumulator to adjust the accumulator to an optimal charge pressure based at least in part on the parameter.

20. The active accumulator system of claim 19, wherein the accumulator comprises the regulator.

21. A method, comprising the steps of:

detecting a parameter at a pump via a transducer coupled to the pump, wherein a fluid flows through a flow line to the pump;

comparing the parameter to a threshold parameter via a controller, wherein the controller is communicatively coupled to an accumulator; and adjusting the accumulator to at least one of an optimal charge pressure or an optimal volume based on the comparison, wherein the accumulator is coupled to the flow line and wherein the at least one of the optimal charge pressure or the optimal volume of the accumulator is adjusted to a minimum suction header pressure of the pump.

22. A method, comprising the steps of:

detecting a parameter at a pump via a transducer coupled to the pump, wherein a fluid flows through a flow line to the pump;

comparing the parameter to a threshold parameter via a controller, wherein the controller is communicatively coupled to an accumulator; and adjusting the accumulator to at least one of an optimal charge pressure or an optimal volume based on the comparison, wherein the accumulator is coupled to the flow line, wherein the adjusting the accumulator to at least one of the optimal charge pressure or the optimal volume comprises at least one of adding gas to the accumulator or withdrawing gas from the accumulator, and wherein the at least one of adding gas to the accumulator or withdrawing gas from the accumulator is performed automatically by a regulator.

* * * * *